US007044063B2

(12) United States Patent
Gordon

(10) Patent No.: US 7,044,063 B2
(45) Date of Patent: May 16, 2006

(54) HOLDER FOR GAMES ACCESSORIES

(76) Inventor: James Gordon, 350 Sorrento Ranches Dr., Nokomis, FL (US) 34275

( * ) Notice: Subject to any disclaimer, the term of this patent is extended or adjusted under 35 U.S.C. 154(b) by 185 days.

(21) Appl. No.: 10/657,074

(22) Filed: Sep. 9, 2003

(65) Prior Publication Data

US 2005/0051059 A1 Mar. 10, 2005

(51) Int. Cl.
*A47B 85/00* (2006.01)

(52) U.S. Cl. ..... 108/26

(58) Field of Classification Search ..... 108/25, 108/26, 43, 44, 90, 152; 273/309, 148 A
See application file for complete search history.

(56) References Cited

U.S. PATENT DOCUMENTS 583,943 A * 6/1897 Rayman ..... 108/26
1,422,397 A * 7/1922 Watson ..... 108/26
1,779,327 A * 10/1930 Moss ..... 108/26
1,793,100 A * 2/1931 Kussman ..... 108/26
1,906,213 A 4/1933 Neuschotz et al.
1,937,994 A * 12/1933 Taylor ..... 108/26
1,938,964 A * 12/1933 Hogue ..... 108/26
1,959,539 A * 5/1934 Latham et al. ..... 108/26
1,962,575 A * 6/1934 Sllverman ..... 108/26
1,979,301 A 11/1934 Webb
2,008,078 A * 7/1935 Martin ..... 108/26
2,106,436 A * 1/1938 Pyle ..... 108/125
2,185,907 A 1/1940 Alexander
2,322,089 A 6/1943 Greitzer
2,572,333 A 10/1951 Greitzer
2,754,167 A 7/1956 Young
3,080,141 A * 3/1963 Ricci ..... 108/26
3,148,636 A * 9/1964 Blomquist et al. ..... 108/26
3,715,122 A 2/1973 Brown
3,784,142 A * 1/1974 O'Brien ..... 108/26
4,099,470 A 7/1978 Cannon, Jr.
5,460,102 A * 10/1995 Pasmanick ..... 108/43
5,558,391 A 9/1996 Chavous
5,720,226 A 2/1998 Padovano
5,913,269 A 6/1999 Franssen
6,152,047 A 11/2000 MacNamara
6,164,213 A * 12/2000 Topps et al. ..... 108/43

* cited by examiner

*Primary Examiner*—José V. Chen
(74) *Attorney, Agent, or Firm*—Browdy and Neimark, PLLC

(57) ABSTRACT

A holder for cards and beverages is designed to fit into cutouts in a table or to comprise a stand-alone box. The holder has a rectangular opening into which are inserted cards or a bidding box, and a circular holder for holding beverage containers in place without tipping.

11 Claims, 6 Drawing Sheets

HOLDER FOR GAMES ACCESSORIES

FIELD OF THE INVENTION

The present invention relates to a holder for accessories used by persons playing cards or other games on a table

BACKGROUND OF THE INVENTION

When a number of persons are seated at a game or conference table, a problem arises in the placement of drinks or snacks, so that they are not in the way of the players or conferees, and so that they will not be knocked over and spilled. While it may be possible to have one or more attachments for the table for this purpose, if the table is a foldable table it is desirable to have an attachment which is separate from the table or which is not in the way when the table is folded and stored, or which can be completely separated from the table.

Several arrangements have been proposed for maintaining drinks, snacks, cards, etc. in positions where they will not be overturned or knocked off of the table. Cannon, Jr., in U.S. Pat. No. 4,099,470, discloses an attachment to a foldable card-table including a rigid tongue which is designed to be interposed between the table top and the table frame. This rigid tongue supports a tray extending out from the edge of the table.

Neuschotz et al., in U.S. Pat. No. 1,906,213, discloses a card table having a plurality of receptacles concealed below its top plate. These receptacles hold cards and other game implements.

Alexander, in U.S. Pat. No. 2,185,907, provides a removable card table tray which is fitted to the corner portions of a conventional card table.

Webb, in U.S. Pat. No. 1,979,301, shows a tray adapted for use with card tables which is swingingly connected to a card table, and is capable of being swung upon a central pivot to a full open position for supporting an ash receptacle, a tumbler, or the like.

Young, in U.S. Pat. No. 2,754,167, shows a card table having extendible shelves associated therewith for supporting beverages and the like.

Mac Namara, in U.S. Pat. No. 6,152,047, even provides a trash receptacle for mounting on a table for conveniently disposing of condiment wrappers, tissues, napkins, and other litter on a table in a restaurant, lounge, or cafeteria.

SUMMARY OF THE INVENTION

It is an object of the present invention to overcome the disadvantages of the prior art.

It is another object of the present invention to provide a holder which is designed to hold objects used on or with a table in place.

It is another object of the present invention to provide a table which holds objects used on the table in such a way that the object will not be tipped over or knocked over.

It is another object of the present invention to provide a holder for use with a table, which holder is used to keep cards and beverages in place without tipping.

It is a further object of the present invention to provide a table with accessories that can be used to hold cards, beverage containers, pencils, etc. in place on the table.

According to the present invention, a holder for cards and beverages is designed to fit into cutouts in a table or to comprise a stand-alone box. The holder has a rectangular opening into which are inserted cards or a bidding box, and a circular holder for holding beverage containers in place without tipping.

In one embodiment of the present invention, the holder is in the form of a box with a detachable cover. The cover can be slipped between the table frame and the table top to keep the holder in place.

A conventional table consists of a top surface disposed on stationary or folding legs. In particular, a card table represents merely one necessary implement required for playing a game of cards. When the table is used for playing cards, the cards, score blanks, pencils, etc. are used on the table. When the table is used for conferences, likewise, pads of paper, writing implements, and beverages are on the table, usually in a precarious position where a hand or arm movement can inadvertently tip them over or brush them off of the table.

In bridge, bidding cards are used, and the table of the present invention has cut outs designed to hold a holder including a card holder in place using a minimum of space and completely preventing any possible tipping or knocking over of the bidding cards. The table is designed to hold a bidding box, such as the one described in Gordon, U.S. Pat. No. 6,491,299, the entire contents of which are hereby incorporated by reference.

The present invention comprises a one-piece holder for cards, pads, beverage containers, and writing implements, that can be placed in cutouts in each corner of the table or than can be contained in a stand-alone box when the holder is placed into cutouts in the table. The top of the holder lies flat on the table, so that tipping of the contents of the holder is minimized. The one-piece holder has a built in drink holder and rack for cards or papers. When the bidding box described above is used, the bidding box is inserted into the cutout in the table.

In one embodiment, a protruding bolt is inserted into a hole in the table. The hole in the table can be of any shape, such as round, square, or hexagonal. To prevent movement, a square or hexagonal hole is preferred. The cardholder is held tightly to the table from underneath the table by fastening a wing nut or a washer and nut to the bolt.

In another embodiment, the holder can be fastened to the table using a strong double-sided tape, or a hook-and-loop type fastener in which one of the elements of the fastener is secured to the table, the other element of the fastener is secured to the holder.

In another embodiment the holder is in a stand-alone box which is placed on top of the table. The stand-alone box can be affixed to the table by double-sided adhesive tape, hook-and-loop fasteners, or the like.

In yet another embodiment the lid of the box is shaped so that the lid can be slipped between the table frame and the table top to hold the box and holder in place. When the lid of the box is closed, it protects the cards inside.

The one-piece holder has a built in holder for beverage container and card rack. The cardholder can be slid into place and held firmly within the holder or the card rack can be seated into a formed opening with snaps or curves to hold it tightly in place.

DETAILED DESCRIPTION OF THE INVENTION

The holder of the present invention can be made of any conventional material, such as wood, plastic, metal, or paperboard. The holder can be stand-alone or designed to fit into openings in a specially designed table as described herein.

Figure 1A:
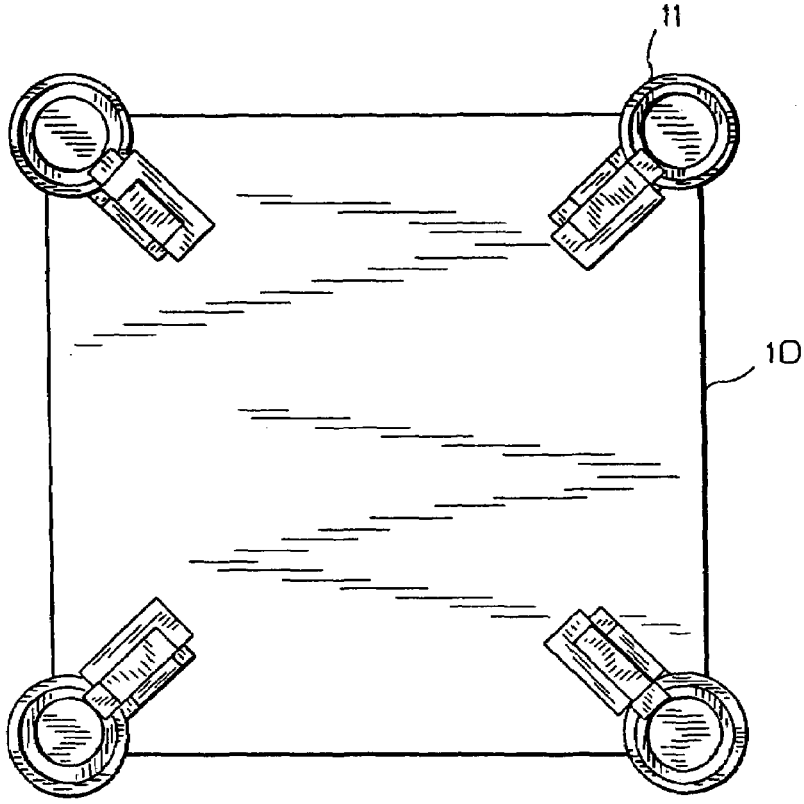
FIG. 1A shows the top of a table according to the present invention in which openings are provided in the table at each corner.
Figure 1B:
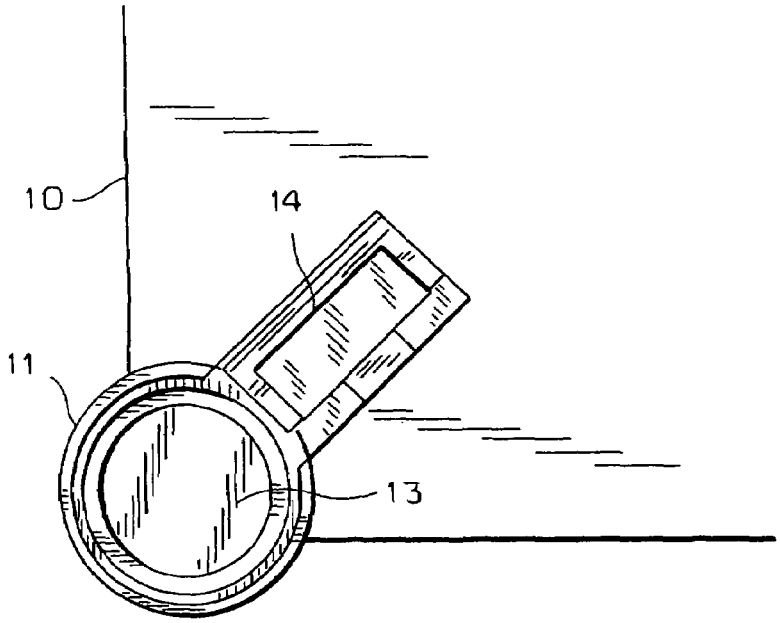
FIG. 1B is a larger view of one edge of the table having a bidding box and cup holder receptacle.

FIG. 1A shows the top of a table 10 according to the present invention with a one-piece card/beverage holder 11 in place in the cutouts in the table. The holder is placed into cutouts in the table so that the holder lies flat on the table. FIG. 1B is an enlarged view of one edge of the table 10 showing the card/beverage holder in place. The holder 11 includes a circular opening 13 for holding a beverage container, and a rectangular opening 14 for holding cards or a bidding box in place.

Figure 2:
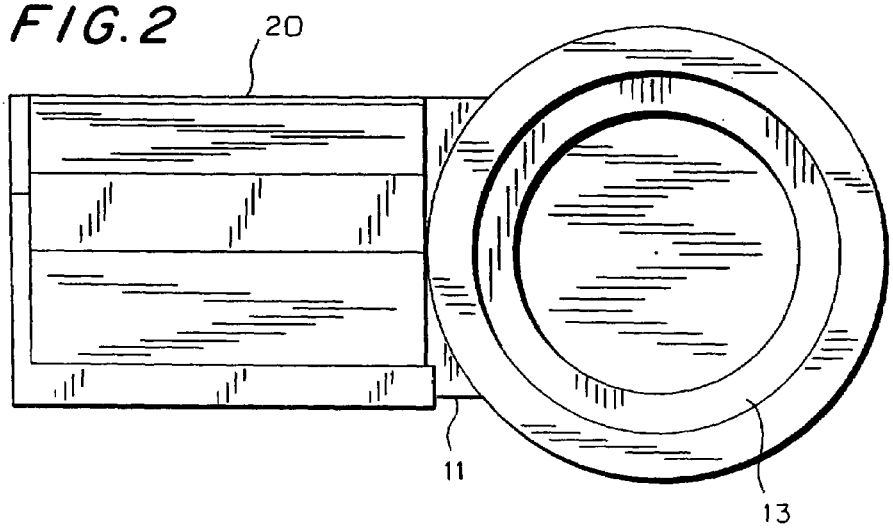
FIG. 2 shows a cardholder in place in the receptacle for cards.
Figure 3:
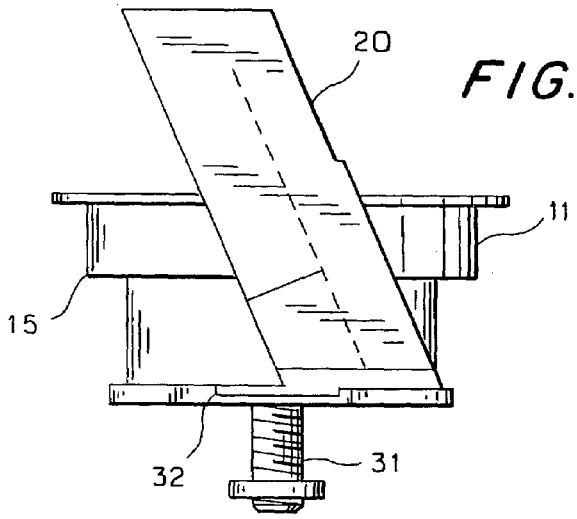
FIG. 3 shows a card holder in which the holder therefore is retained in place using double sided tape.

FIG. 2 illustrates how the cardholder 20 fits into the holder 11. Preferably, as shown in FIG. 3, the cardholder 11 is held at an angle so that the cards are easily read, and there is more space to see over the cards. The cardholder 11 may have a stepped side 15 in which the size of the cardholder is diminished.

In one embodiment of the present invention, shown in FIG. 3, a protruding bolt 31 is inserted into the cutout 32 in the table. The hole can be of any shape, such as square, round, or hexagonal, but, to prevent movement of the holder, a square or hexagonal hole is preferred.

The holder 11 can be made of any suitable material, as described above, such as a rigid plastic. If desired, separate colors can be used for each holder.

Figure 4:
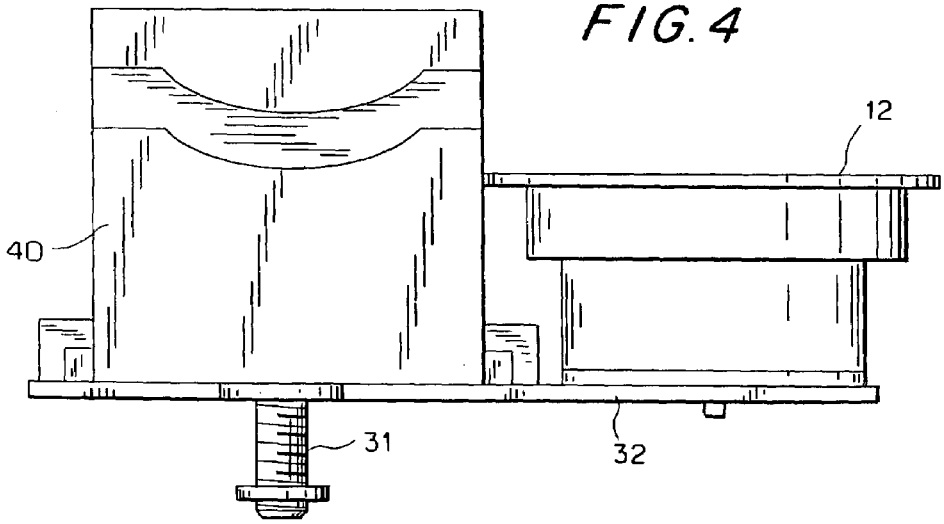
FIG. 4 is a side view of FIG. 2.

FIG. 4 is a side view of FIG. 2, showing a bidding box 40 in the cardholder 11, as well as the beverage holder 12.

Figure 5:
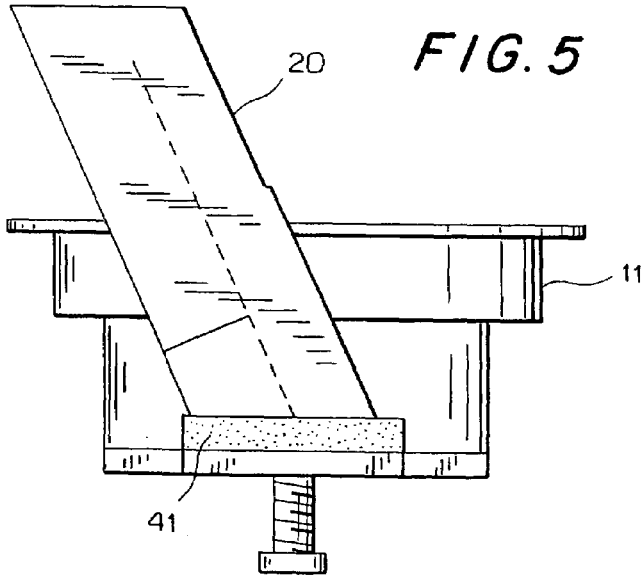
FIG. 5 is a side view of a bidding box in place in which the holder is held in place using a bolt.

FIG. 5 shows the cardholder 20 at an angle in the holder 11. In this case, the cardholder 20 is secured by a double-sided tape 41.

Figure 6:
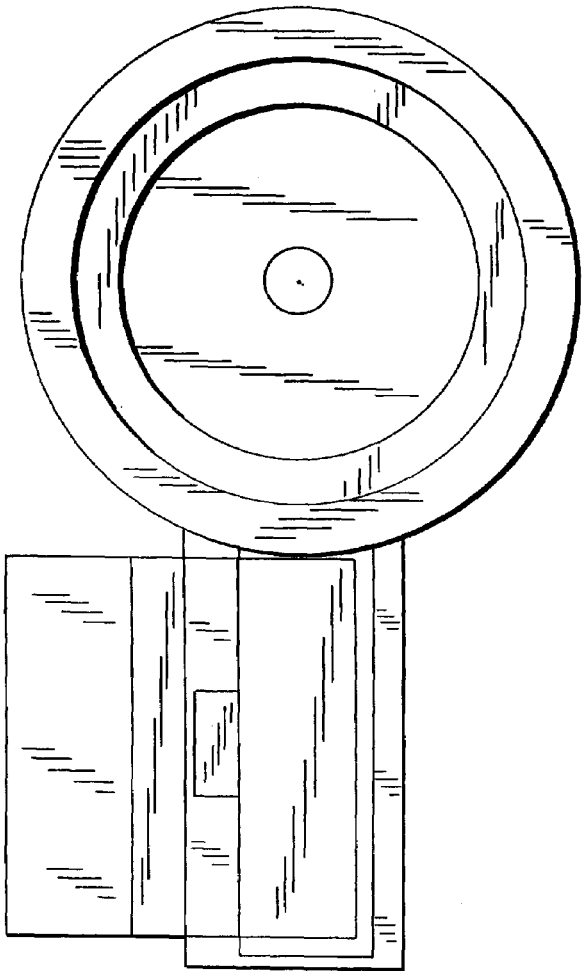
FIG. 6 is a top plan view of FIG. 5.

FIG. 6 is a side view of FIG. 5, showing both the beverage holder and the cardholder sections of the holder 11.

Figure 7:
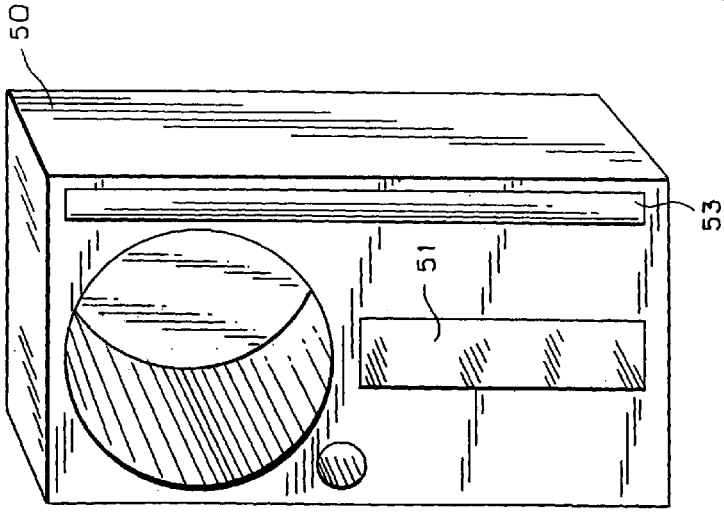
FIG. 7 shows a box for holding drink containers and a bidding box.

In another embodiment of the invention, shown in FIG. 7, a stand-alone box 50 holds both beverages and cards. There is an opening for cards 51 and an opening for a beverage container 52. The box 50 is provided with a groove 53 to hold a pen or pencil.

The box can be of any convenient size, either to fit onto part of a table or to cover the entire table. The box can be for temporary use; in this case it is preferable to have a non-skid back on the bottom of the box to minimize sliding of the box on the table during play. Alternatively, the box can be more permanently affixed to the table using double-sided tape of hook and loop fasteners, or any other type of fastening or adhesive means.

The box can be made of any material that is sufficiently stiff so that the cards and beverages can be held without the box collapsing. Among the materials that can be used to make the box are cardboard, plywood, paperboard, and plastic. In a preferred embodiment, the cover is clear plastic.

The box holder can be configured for either right- or left-handed people by reversing the location of the card holder with respect to the beverage holder so that a player, reaching for a beverage, does not inadvertently brush the cards.

Figure 8:
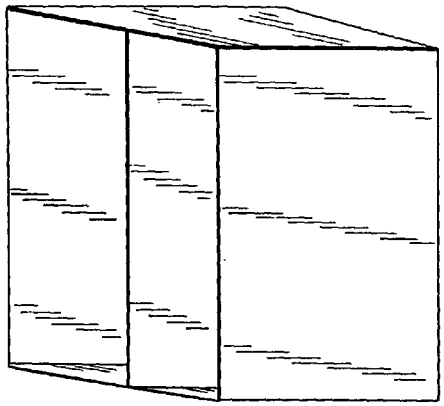
FIG. 8 shows a bidding box holder.
Figure 9:
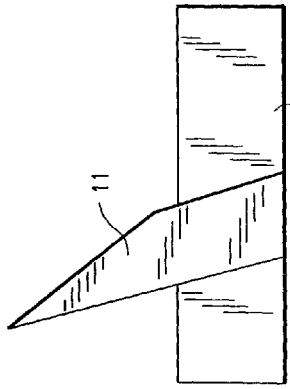
FIG. 9 is an end view of the box with the cardholder in position.

FIG. 9 is an end view of the box with the cardholder 11 in place. FIG. 8 illustrates the bidding cards holder.

Figure 11:
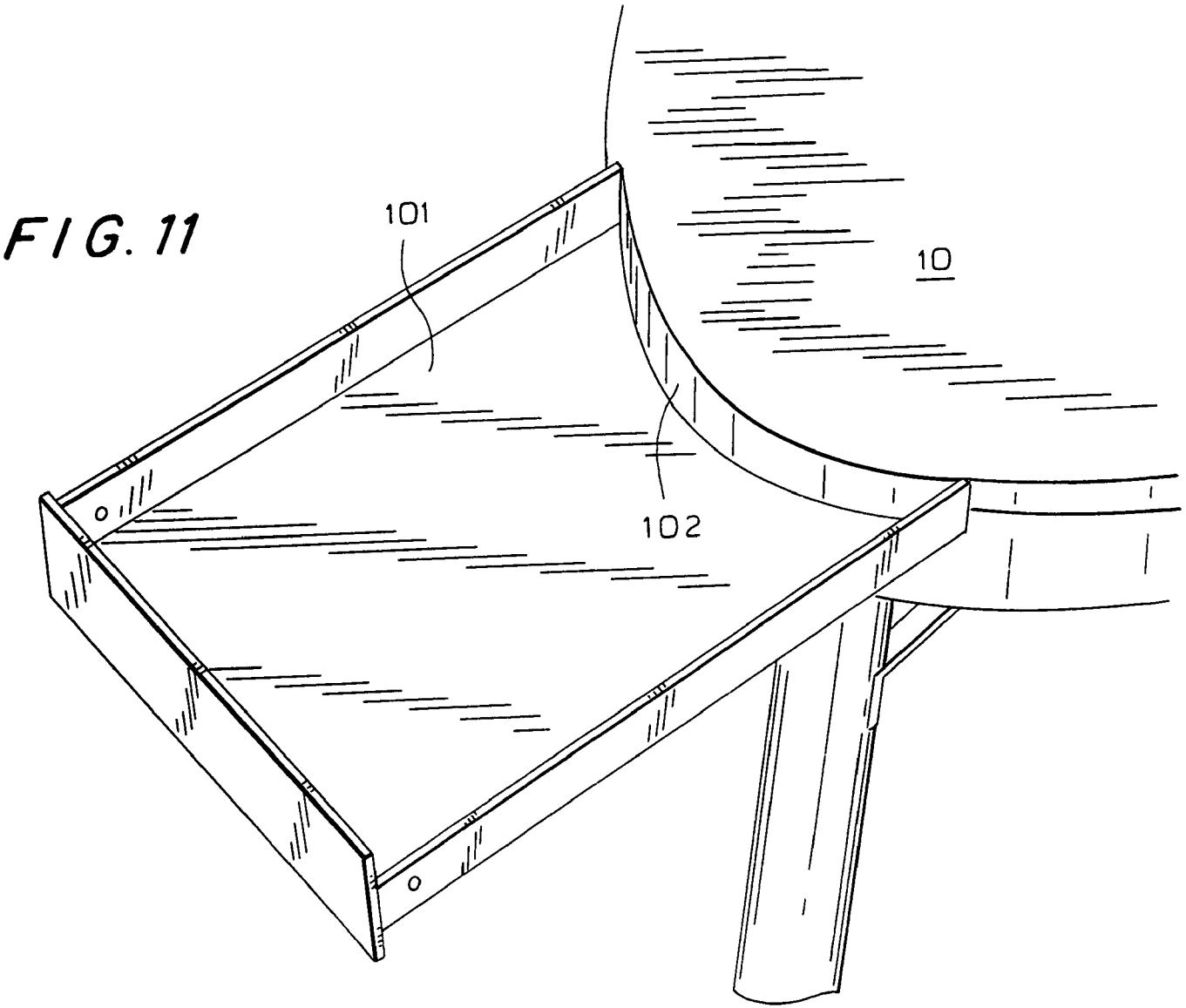
FIG. 11 shows the cover for the bidding box attached to a side of a bridge table by being slipped between the table top and the table frame.

FIG. 11 shows a support 101 for the bidding box attached to a table 10. This support keeps the bidding box, including the cards, beverage, pencil, etc., below the level of the playing surface.

Figure 12:
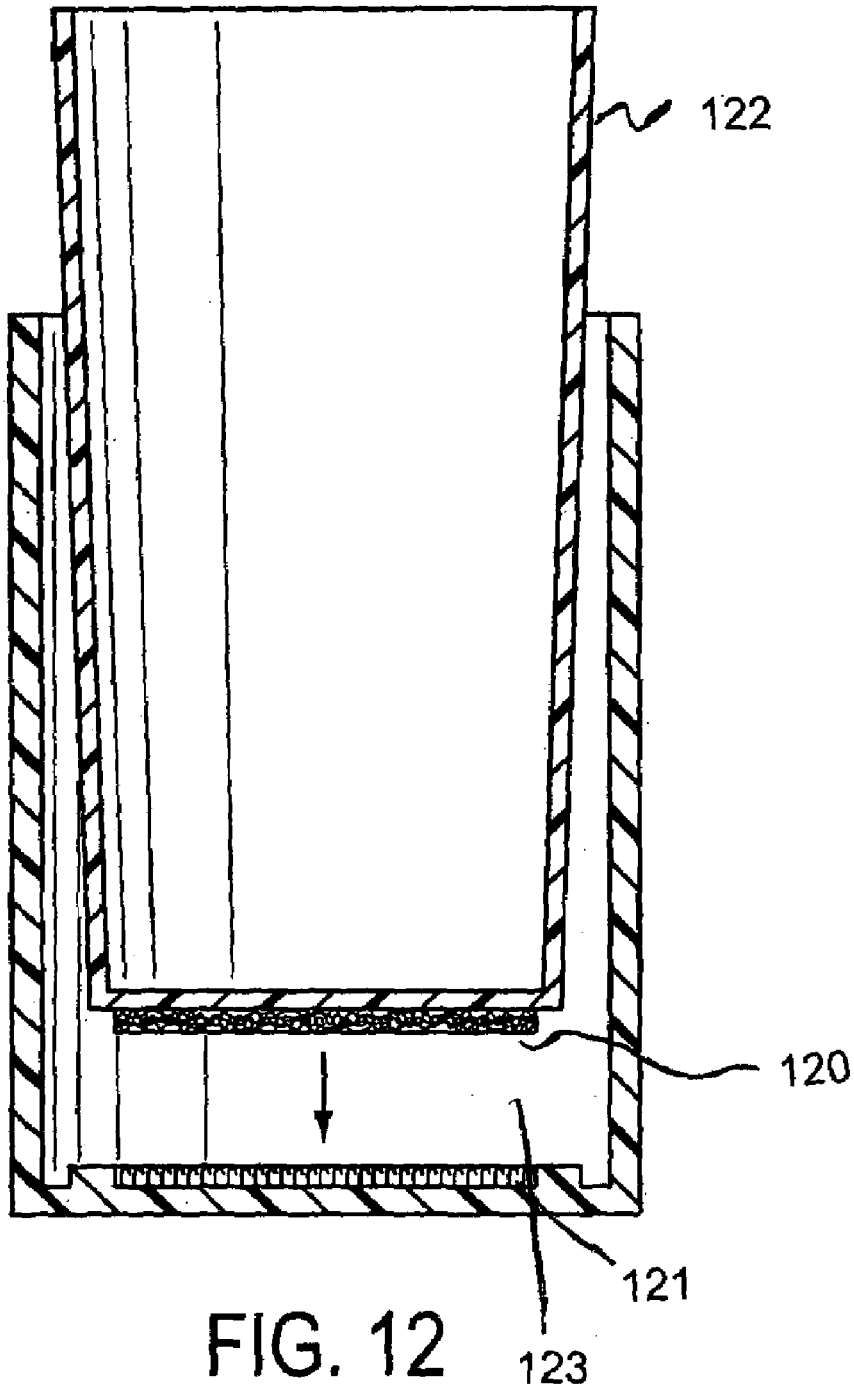
FIG. 12 shows a holder secured to a recess in a table by hook and loop fasteners.

FIG. 12 shows hook and loop fasteners 120, 121, for securing a holder 122 to a recess 123 in the table.

In another embodiment of the present invention, the cover of the box is constructed so that it can fit into the side of a bridge table. Most bridge tables are not made of wood, but are made of a metal frame onto which is superposed a cover. The cover of the box of the present invention 101 can be made as shown in FIG. 11, in which one side of the cover has been cut off. In this configuration, the side of the cover 102 where the side piece is cut off can be inserted between the cover of the table and the frame of the table, as shown in FIG. 11. In this configuration, the cover extends from the back of the table so that there is room to place a bidding box but the entire surface of the table remains clear. Optional grooves or nipples can be provided on the cover to hold the box in place when it is inserted between the cover of the table and the frame. In this case the cover snaps into place between the table cover and the frame of the table, and the card holder can be maintained in a flat position.

Of course, since the box is held in place on the table by friction fit, there is no need for tape, bolts, or any other type of external adhesive to maintain the box in place.

Thus, the present invention provides holders for cards, beverages, and other game accessories in order to maintain the accessories in one accessible place while preventing spillage of beverages. In one embodiment a game table is provided with cut outs to hold a holder comprising a card holder and a beverage holder. This arrangement keeps the cards and beverages at the place of each player. Preferably, the cutouts are near each corner of the table so as to minimize interference with the table surface used for playing. The holder can be fastened to the table in the cutouts using a bolt. However, one can also use double-sided tape or hook-and-loop fasteners to maintain the holder 11 in place in the cutout.

In another embodiment, a stand-alone box 50 is provided which holders both cards and beverages. This stand-alone box is also preferably affixed to the table surface with double-sided tape or a hook-and-loop fastener.

Figure 10:
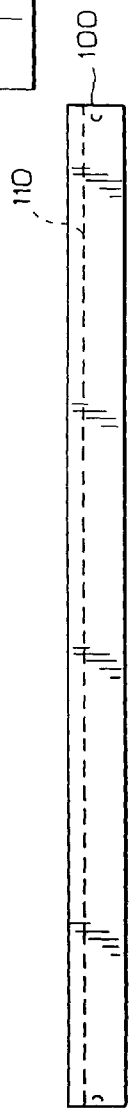
FIG. 10 shows a cover for the bidding box.

In a further embodiment, shown in FIG. 10, a support 101 for the box is attached to the side of the table so that the box is below the surface of the table.

The cardholder is placed into the holder and slid into place and held firmly in place by a bolt or double-sided tape, etc., or it can be seated into a formed opening with snaps or curves to hold it tightly. With this design, each player with a bidding box can take place his or her individual bidding box into the box 50.

A cover 100 for the box is shown in FIG. 11. The cover is made slight larger and wider than the box so that the cover snaps on with a slight detent on the box. Small raised dots 110 are placed along the ends of the cover 100. The dots are placed sufficiently low on the cover so that the dots allow the cover to hold on properly. Preferably, the cover is made of clear plastic.

The holder 11 or stand-alone box 50 can be made of any suitable material, such as wood, plastic, cardboard, pressed wood, etc. However, for cost savings, molded plastic is durable and inexpensive. In order to prevent obstruction of the view, the cardholder can be either straight up or angled. A slight angle is preferred, as long as the players can see the bid. A slight angle also gives each player a clear view of the table.

The foregoing description of the specific embodiments will so fully reveal the general nature of the invention that others can, by applying current knowledge, readily modify and/or adapt for various applications such specific embodiments without departing from the generic concept, and, therefore, such adaptions and modifications should and are intended to be comprehended within the meaning and range of equivalents of the disclosed embodiments. It is to be understood that the phraseology or terminology employed herein is for the purpose of description and not of limitation.

What is claimed is:

1. A game table having cutouts at each corner of the table, said cutouts being in the shape of a holder for cards and beverages which holder for cards is maintained at an angle, and a holder for cards and beverages, said holder being in one piece and having a circular recess for beverages and a rectangular recess for cards.

2. The table according to claim 1 wherein the holders are secured to the table by a bolt.

3. The table according to claim 1 wherein the holders are secured to the table by double-sided tape.

4. The table according to claim 1 wherein the holders are secured to the table by hook and loop fasteners, wherein one side of the hook and loop fastener is in the bottom of the cutouts of the table, and the other side of the hook and loop fastener is on the bottom of the holder.

5. The table according to claim 1 wherein the cardholder has a stepped interior side in which the size of the cardholder is diminished.

6. The table according to claim 1 wherein the cardholder also includes a bidding box.

7. A stand alone holder for beverages and cards comprising a box with nonskid backing or other devices for permanently affixing the box to a table top, said box having a top, front, and at least two sides, and wherein the top includes a circular cutout for holding beverages, and a rectangular cutout for holding a card storage device selected from the group consisting of card holders or bidding boxes, wherein the bidding box comprises a top part and a bottom part, the top part including cut out portion which holds the bottom part in upright position, and the bottom part is angled such that when the bottom part is placed into the cut out portion of the top part, the bottom part leans backward.

8. The holder according to claim 7 wherein a divider is placed in the card storage area.

9. The holder according to claim 7 further comprising a top for the bidding box or card holder.

10. The holder according to claim 7 including a cover having two or three side pieces and an end having no side piece and a bottom, and adapted and constructed so that the end of the cover having no side piece is inserted into a bridge table between a frame of the bridge table and a cover of the bridge table.

11. The holder according to claim 10 further including a nipple or groove in at least one side piece so that the holder is adapted and constructed to snap into place when inserted into the bridge table.

* * * * *